US010343827B2

(12) United States Patent
Tapocik

(10) Patent No.: US 10,343,827 B2
(45) Date of Patent: Jul. 9, 2019

(54) CHILD-RESISTANT LOCKING CAP FOR LAMINATED TUBES

(71) Applicant: Bryan Tapocik, Highland, CA (US)

(72) Inventor: Bryan Tapocik, Highland, CA (US)

(73) Assignee: Innovative Product Brands, Inc., Highland, CA (US)

( * ) Notice: Subject to any disclaimer, the term of this patent is extended or adjusted under 35 U.S.C. 154(b) by 46 days.

(21) Appl. No.: 15/396,725

(22) Filed: Jan. 2, 2017

(65) Prior Publication Data

US 2018/0186523 A1 Jul. 5, 2018

(51) Int. Cl.

| | |
|---|---|
| ***B43M 11/06*** | (2006.01) |
| ***B65D 50/04*** | (2006.01) |
| ***A61J 1/14*** | (2006.01) |
| ***B65D 47/42*** | (2006.01) |

(52) U.S. Cl.

CPC ..... *B65D 50/043* (2013.01); *A61J 1/1418* (2015.05); *B65D 47/42* (2013.01); *B65D 2215/02* (2013.01)

(58) Field of Classification Search

CPC ... B65D 50/043; B65D 2215/02; A61J 1/1418

USPC ..... 401/213, 183

See application file for complete search history.

(56) References Cited

U.S. PATENT DOCUMENTS

| | | | | |
|---|---|---|---|---|
| 5,290,105 | A * | 3/1994 | Tencati | B65D 75/5883 215/12.2 |
| 6,179,505 | B1 * | 1/2001 | Oder, III | A45D 34/041 401/213 |
| 7,527,159 | B2 * | 5/2009 | Brozell | B65D 41/0471 215/222 |
| 2005/0072792 | A1 * | 4/2005 | Harrold | B65D 35/38 222/48 |
| 2016/0243319 | A1 * | 8/2016 | Szymiczek | B05B 11/0032 |
| 2017/0113851 | A1 * | 4/2017 | Martin | B65D 50/043 |
| 2018/0140813 | A1 * | 5/2018 | Tapocik | A61M 35/003 |

* cited by examiner

*Primary Examiner* — Jennifer C Chiang
(74) *Attorney, Agent, or Firm* — Thomas I. Rozsa

(57) ABSTRACT

A combination of a container made out of rolled laminated plastic or rolled laminated metal combined with a rollerball applicator, combined with a child-resistant locking assembly between the container and a cap removably affixed to the container. The container includes a closed rear end, a front wall and a flexible sidewall between the closed rear end and the front. The flexible sidewall is in a shape selected from the group consisting of oval-shaped, elliptical-shaped and cylindrical-shaped.

15 Claims, 11 Drawing Sheets

CHILD-RESISTANT LOCKING CAP FOR LAMINATED TUBES

BACKGROUND OF THE INVENTION

1. Field of the Invention

The field of the invention relates to the area of containers with contents that require security to prevent a child from opening the container.

2. Description of the Prior Art

The present inventor is not aware of any prior art relating to his invention.

SUMMARY OF THE INVENTION

The present invention is a combination of a container made out of rolled laminated plastic or rolled laminated metal combined with a rollerball applicator, combined with a child-resistant locking assembly between the container and a cap removably affixed to the container The container includes a closed rear end, a front wall and a flexible sidewall between the closed rear end and the front wall. The flexible sidewall is in a shape selected from the group consisting of oval-shaped, elliptical-shaped and cylindrical-shaped.

The shape of the container is optional but preferably in the shape of a tube of toothpaste closed at a rear end and having a generally oval-shaped or generally elliptical-shaped sidewall and a front end having a front wall with an opening through which an applicator partially extends. The closed rear end, sidewall, front wall and portion of the applicator surround an interior chamber in which there is retained material which could be hazardous to a child, hereafter referred to as "a precautionary material". The applicator is used to dispense the precautionary material. The applicator is preferably a rollerball. It is within the spirit and scope of the present invention to include other types of applicators.

It is also within the spirit and scope of the present invention for the container to be cylindrical in shape with a closed rear end, a cylindrical sidewall and a front end having a front wall with an opening through which an applicator partially extends. The closed rear end, sidewall, front wall and portion of the applicator surround an interior chamber in which there is retained a precautionary material. The applicator is used to dispense the precautionary material. The applicator is preferably a rollerball. It is within the spirit and scope of the present invention to include other types of applicators.

The first key feature of the present invention is that the container is made of material selected from the group consisting of rolled laminated plastic and rolled laminated aluminum each having from one (1) to eight (8) layers of rolled laminated plastic or aluminum. The plastic is selected from the group consisting of polypropylene, polyethylene or combinations including one or more of these plastics. An important feature of the present invention is for a sidewall of the container, regardless of shape, to be flexible and squeezable so that the precautionary material is forced onto (or into depending on the applicator) the applicator which dispenses the precautionary material. The precautionary material may be dispensed onto the skin or fingernail or toenail of a person or onto or into a surface, cavity, or other location of an object depending on what the precautionary material is and its intended use.

The second key feature of the present invention is that the applicator and at least a portion of the front wall of the container are closed by a removable child-resistant locking cap. The locking cap includes at least one, and preferably a pair, of locking teeth. The front wall of the container has at least one mating locking member to be engaged by the at least one locking tooth, or preferably a pair of spaced apart mating locking members to be respectively engaged by a respective locking tooth. The child-resistant locking cap has a location portion as part of the locking assembly to enable a locking tooth from the locking cap to be aligned with a respective mating locking member. The location portion on the wall of the locking cap requires knowledge of being able to find the location and cause the locking cap to rotate to perform the required alignment of each locking tooth with a respective mating locking member.

The third novel, but optional feature of the present invention is for the applicator to be a rollerball.

The present invention also include a cap removably affixed to the container with a unique child-resistant locking member to prevent a child from removing the cap and gaining access to the precautionary material within the container.

It is an object of the present invention to create a container made of rolled laminated plastic or rolled laminated aluminum each having from one (1) to eight (8) layers of rolled laminated plastic or aluminum to have a flexible sidewall to facilitate dispensing of a precautionary material within an internal chamber of the container.

It is also an object of the present invention to include a child-resistant locking assembly between the container and the removable cap to reduce the ability of a child to remove the locking cap and gain access to the precautionary material inside the container.

Further novel features and other objects of the present invention will become apparent from the following detailed description and discussion.

BRIEF DESCRIPTION OF THE DRAWINGS

Referring particularly to the drawings for the purpose of illustration only and of limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Figure 1:
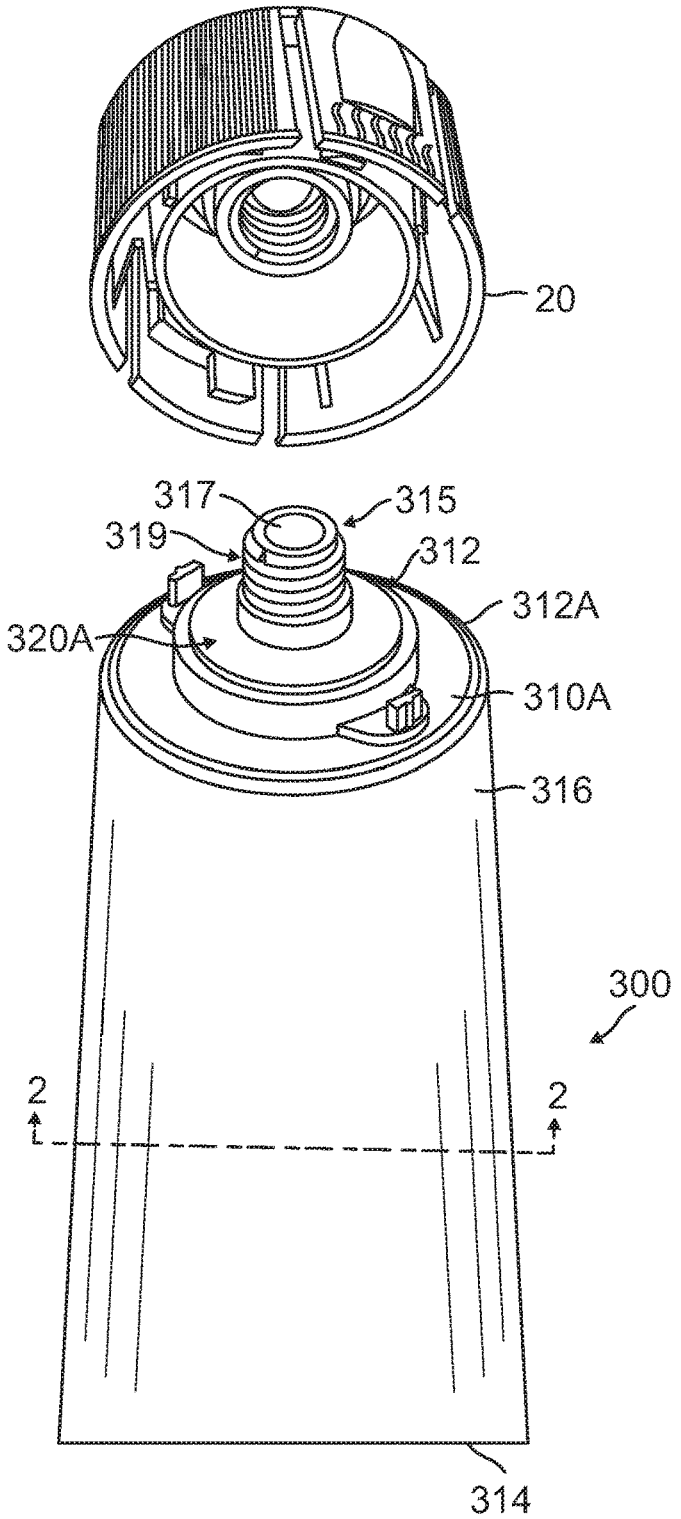
FIG. 1 is an exploded view of the present invention cap and a side perspective view of an oval-shaped container embodying a portion of the present invention.

Referring to FIG. 1, there is illustrated an exploded view of the cap 20 of the present invention viewed in a bottom perspective view and an oval-shaped container 300 illustrated in a side perspective view.

Further referring to FIG. 1, there is illustrated a perspective view of an oval-shaped container 300 in which precautionary material, such as medicines, poison, and flammable material are contained in interior chamber 318. It is within the spirit and scope of the present invention to include any items which may be hazardous or harmful to a child or any person if not handled properly.

Figure 3:
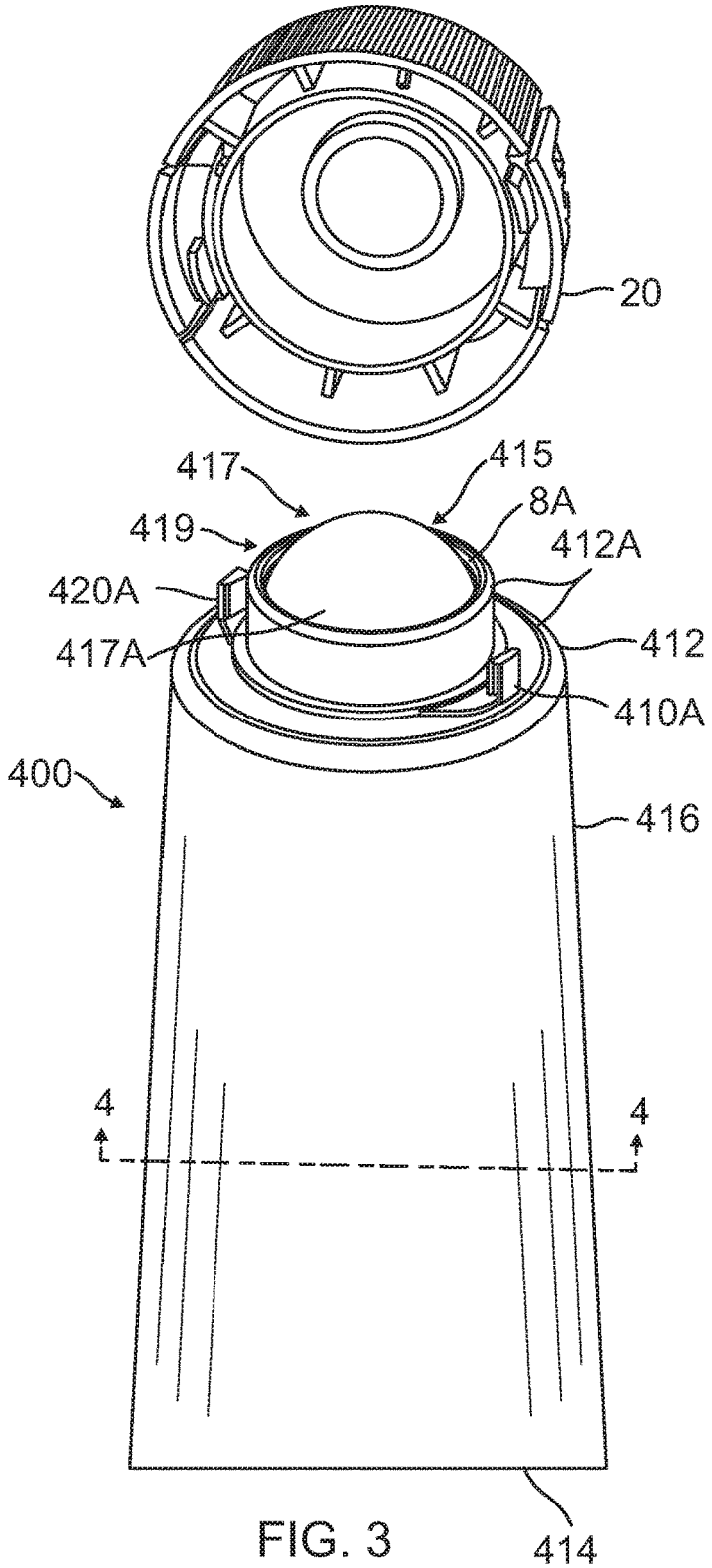
FIG. 3 is an exploded view of the present invention cap and a side perspective view of an elliptical container embodying a portion of the present invention.
Figure 4:
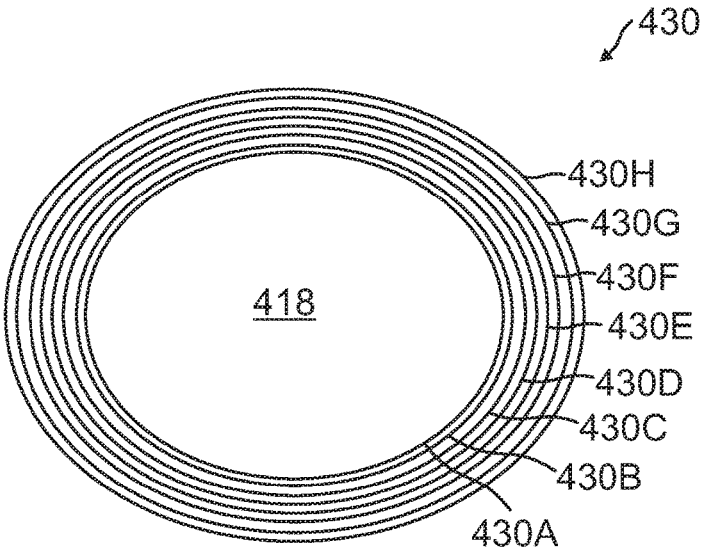
FIG. 4 is a cross-sectional view taken along line 4-4 of FIG. 3.

FIGS. 3 and 4 illustrate an alternative embodiment of the present invention having an elliptical-shaped sidewall. Referring to FIG. 3, there is illustrated an exploded view of the cap 20 of the present invention viewed in a bottom perspective view and an elliptical-shaped container 400 illustrated in a side perspective view.

Further referring to FIG. 3, there is illustrated a perspective view of an elliptical-shaped container 400 in which precautionary material, such as medicines, poison, and flammable material are contained in interior chamber 418. It is within the spirit and scope of the present invention to include any items which may be hazardous or harmful to a child or any person if not handled properly.

The elliptical-shaped container 400 has a closed rear end 414, an elliptical-shaped sidewall 416, a front end 412 with a front wall 412A supporting a central nozzle 415 having a central opening 417 through which a rollerball applicator 417A partially extends away from the centralized nozzle and is in contact with the contents 8A in interior chamber 418. It is also within the spirit and scope of the present invention for the rollerball applicator 417A to extend directly out of opening 415 without the nozzle. The rollerball applicator then partially extends out of front wall 412A and is partially in contact with chamber 418 so that it comes in contact with the retained precautionary material 8A to dispense the precautionary material. Also illustrated are standoffs 410A and 420A.

The elliptical wall 416 is flexible and squeezable to dispense interior contents to the rollerball applicator. The rear end 414, elliptical-shaped sidewall 416 and front wall 412 surround an interior chamber 418 (see FIG. 4) to retain at least one of the precautionary materials 8A.

Referring to the cross-sectional view of FIG. 4, the elliptical container 410 is made of material selected from the group consisting of rolled laminated plastic and rolled laminated aluminum 430, each having from one (1) to eight (8) layers 430A, 430B 430C, 430D, 430E, 430F, 430G and 430H of rolled laminated plastic or aluminum. The plastic is selected from the group consisting of polypropylene, polyethylene, polyvinyl or combinations including one or more of these plastics. This rolled laminated material creates a flexible sidewall so that the contents 8A can be squeezed out of interior chamber to be dispensed.

Figure 5:
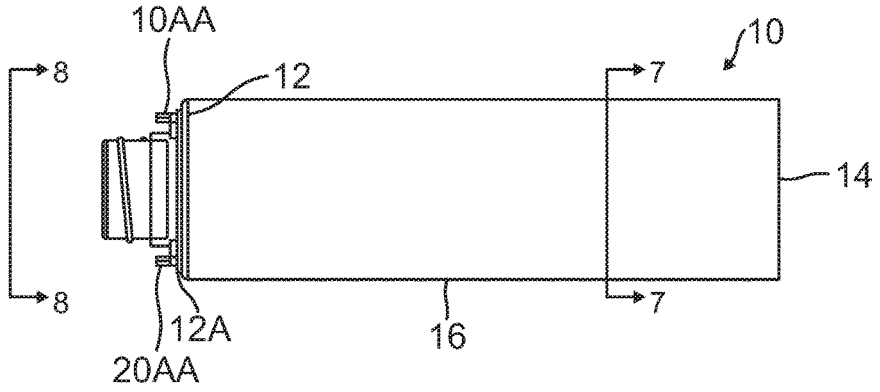
FIG. 5 is a side elevational view of a cylindrical-shaped container embodying a portion of the present invention.
Figure 6:
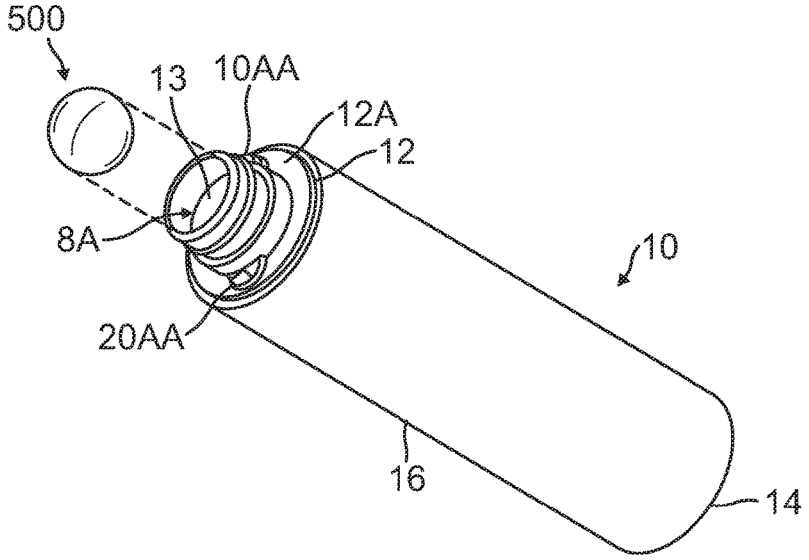
FIG. 6 is a side perspective view of a cylindrical-shaped container embodying a portion of the present invention.
Figure 7:
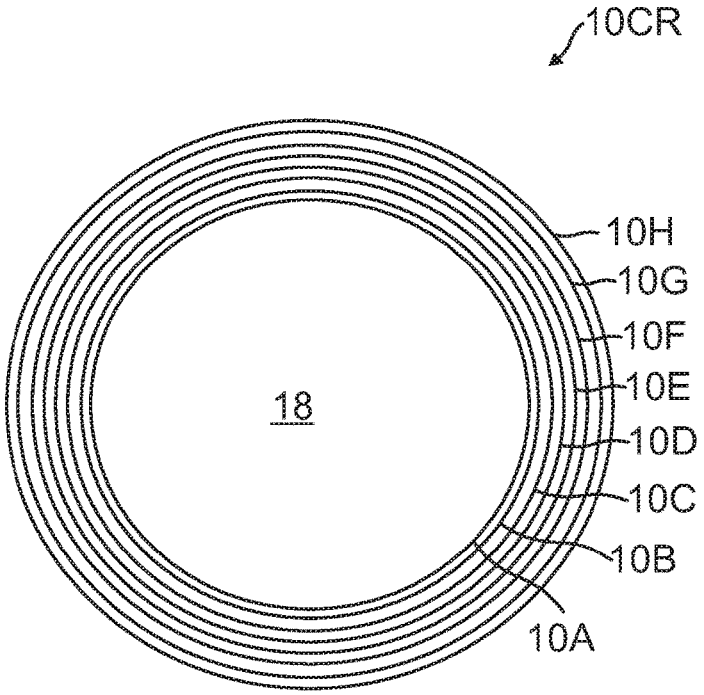
FIG. 7 is a cross-sectional view taken along line 7-7 of FIG. 5.
Figure 8:
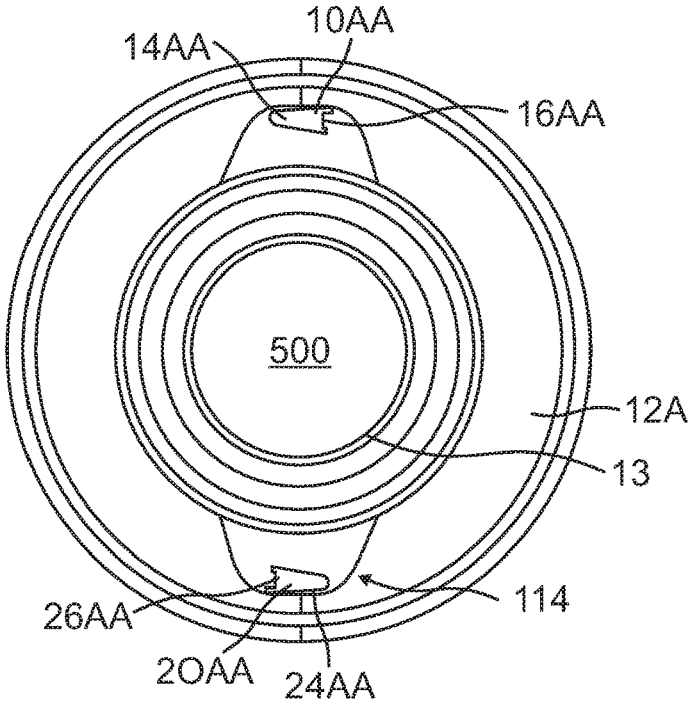
FIG. 8 is a front view taken from lines 8-8 of FIG. 5 to illustrate the mating locking members, also called tube standoff, affixed to the front wall of a container, including containers having an oval-shaped sidewall, an elliptical-shaped sidewall, and a cylindrical-shaped sidewall.

A third cylindrical variation of the container is illustrated in FIGS. 5 through 8. FIG. 5 is a side elevational view of a cylindrical-shaped container embodying a portion of the present invention. FIG. 6 is a side perspective view of a cylindrical-shaped container embodying a portion of the present invention. FIG. 7 is a cross-sectional view taken along line 7-7 of FIG. 5. FIG. 8 is a front view taken from lines 8-8 of FIG. 5 to illustrate the mating locking members, also called tube standoff, affixed to the front wall of a container, including containers having an oval-shaped sidewall, an elliptical-shaped sidewall, and a cylindrical-shaped sidewall.

FIGS. 3 and 4 illustrate an alternative embodiment of the present invention having an elliptical-shaped sidewall. Referring to FIG. 3, there is illustrated an exploded view of the cap 20 of the present invention viewed in a bottom perspective view and an elliptical-shaped container 400 illustrated in a side perspective view.

Further referring to FIG. 3, there is illustrated a perspective view of an elliptical-shaped container 400 in which precautionary material, such as medicines, syringes, poison, and flammable material are contained. It is within the spirit and scope of the present invention to include any items which may be hazardous or harmful to a child or any person if not handled properly.

Further referring to FIG. 1, oval shaped container 300 has a closed rear end 314, an oval-shaped sidewall 316, a front end 312 with a front top wall 312A surrounding a front wall 310A. A supporting collar including a collar top wall 320A supporting a central top nozzle 315 having threads on its exterior surface, the nozzle 315 including a top opening with at least a portion of a central rollerball applicator 317 extending through the opening. The cap 20 will be described in detail later on in this patent application. As illustrated in FIG. 1, the cap 20 includes an interior central collar with mating interior threads which mate with threads 315T as the cap 20 is threaded onto the nozzle 315.

The elliptical-shaped container 400 has a closed rear end 414, an elliptical-shaped sidewall 416, a front end 412 with a front wall 412A supporting a central nozzle 415 having a central opening 417 through which a rollerball applicator 417A partially extends away from the centralized nozzle and is in contact with the contents 8A in interior chamber 418. It is also within the spirit and scope of the present invention for the rollerball applicator 417A to extend directly out of opening 415 without the nozzle. The rollerball applicator then partially extends out of front wall 412A and is partially in contact with chamber 418A so that it comes in contact with the retained precautionary material 8A to dispense the precautionary material.

The elliptical wall 416 is flexible and squeezable to dispense interior contents to the rollerball applicator. The rear end 414, elliptical-shaped sidewall 416 and front wall 412 surround an interior chamber 418 (see FIG. 4) to retain at least one of the precautionary materials 8A.

Figure 2:
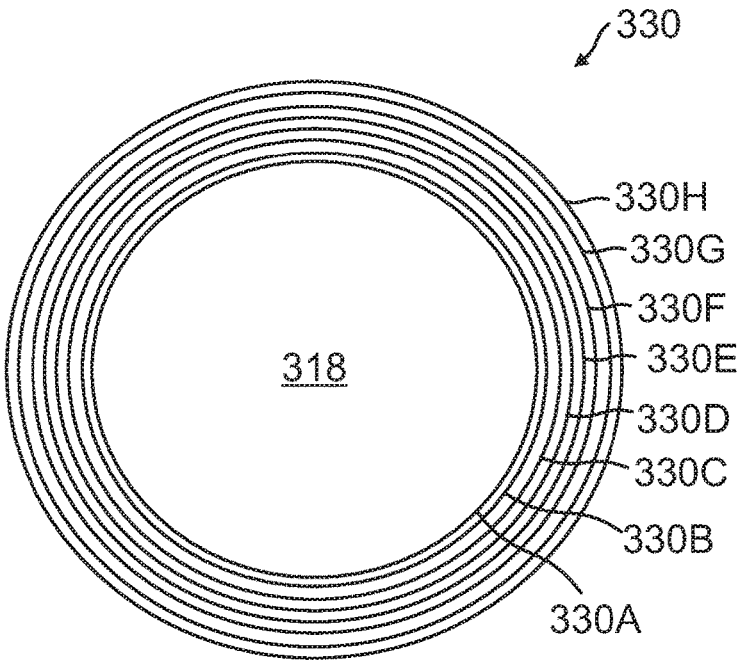
FIG. 2 is a cross-sectional view taken along line 2-2 of FIG. 1.

Referring to the cross-sectional view of FIG. 2 the oval-shaped container 410 is made of material selected from the group consisting of rolled laminated plastic and rolled laminated aluminum 430, each having from one (1) to eight (8) layers 430A, 430B, 430C, 430D, 430E, 430F, 430G and 430H of rolled laminated plastic or aluminum. The plastic is selected from the group consisting of polypropylene, polyethylene, polyvinyl or combinations including one or more of these plastics. This rolled laminated material creates a flexible sidewall so that the contents 8 can be squeezed out of the interior chamber to be dispensed.

A third cylindrical variation of the container is illustrated in FIGS. 5 through 8. FIG. 5 is a side elevational view of a cylindrical-shaped container embodying a portion of the present invention. FIG. 6 is a side perspective view of a cylindrical-shaped container embodying a portion of the present invention. FIG. 7 is a cross-sectional view taken from line 7-7 of FIG. 5. FIG. 8 is a front view taken from line 8-8 of FIG. 5.

FIGS. 5 through 8 illustrate an alternative embodiment of the present invention having a cylindrical-shaped sidewall.

Further referring to FIG. 5 through 7, there is illustrated a cylindrical-shaped container 10 in which precautionary material, such as medicines, syringes, poison, and flammable material are contained. It is within the spirit and scope of the present invention to include any items which may be hazardous or harmful to a child or any person if not handled properly.

The cylindrical-shaped container 10 has a closed rear end 14, a cylindrical-shaped sidewall 16, a front end 12 with a front wall 12A and a central opening 13 through which rollerball applicator 500 partially extends away from front wall 12A and is in contact with the contents 8A in interior chamber 18. Therefore, it is also within the spirit and scope of the present invention for the rollerball applicator 500 to extend directly out of opening 13. The rollerball applicator 500 then partially extends out of front wall 12AA and is partially in contact chamber 18 so that it comes in contact with the retained precautionary material 8A to dispense the precautionary material.

The cylindrical wall 16 is flexible and squeezable to dispense interior contents to the rollerball applicator. The rear end 14, cylindrical-shaped sidewall 16 and front wall 12A surround an interior chamber 18 (see FIG. 7) to retain at least one of the precautionary materials 8A.

Referring to the cross-sectional view of FIG. 7, the cylindrical-shaped container 10CR is made of material selected from the group consisting of rolled laminated plastic and rolled laminated aluminum 10CR, each having from one (1) to eight (8) layers 10A, 10B, 10C, 10D, 10E, 10F, 10G and 10H of rolled laminated plastic or aluminum. The plastic is selected from the group consisting of polypropylene, polyethylene, polyvinyl or combinations including one or more of these plastics. This rolled laminated material creates a flexible sidewall so that the contents 8A can be squeezed out of the interior chamber to be dispensed.

An important innovation of the present invention is a child-resistant locking assembly generally referred to as 100 in the subsequent figures. While illustrated using the cylindrical-shaped sidewall, the same locking assembly is also utilized with other shaped container having the above described oval-shaped sidewall 316 and elliptical-shaped sidewall 416.

Figure 9:
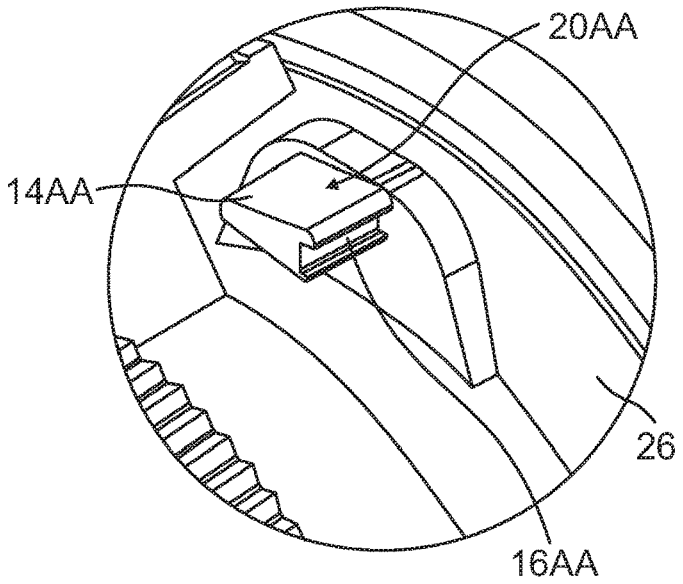
FIG. 9 is an enlarged view of a tube standoff.
Figure 10:
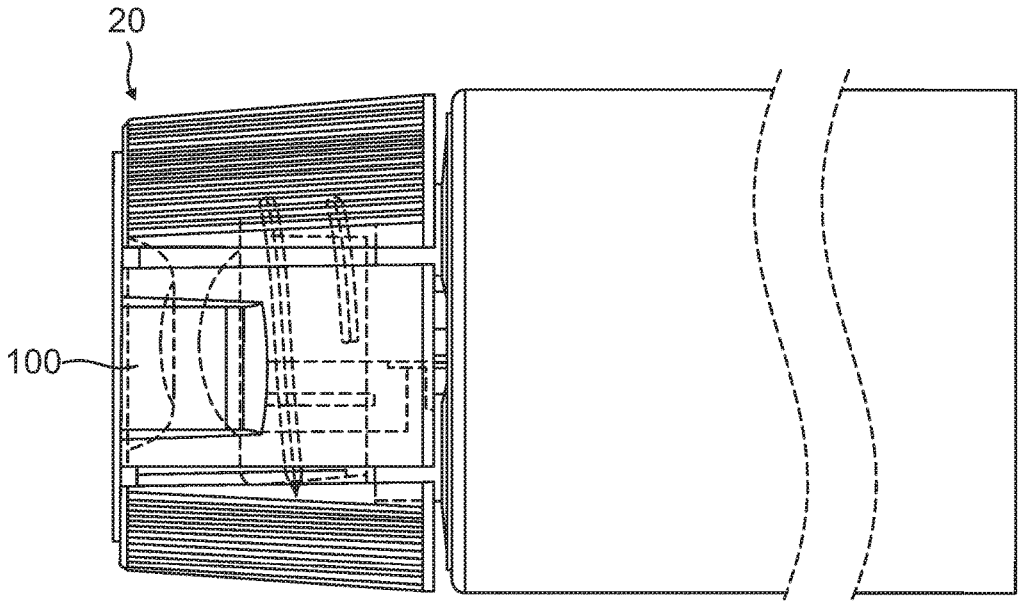
FIG. 10 is a side view of the cap illustrated in partial cross-section to illustrate a portion of the locking cavity within the cap.

FIG. 9 is an enlarged view of a tube standoff. FIG. 10 is a side view of the cap illustrated in partial cross-section to illustrate a portion of the locking cavity within the cap.

Figure 11:
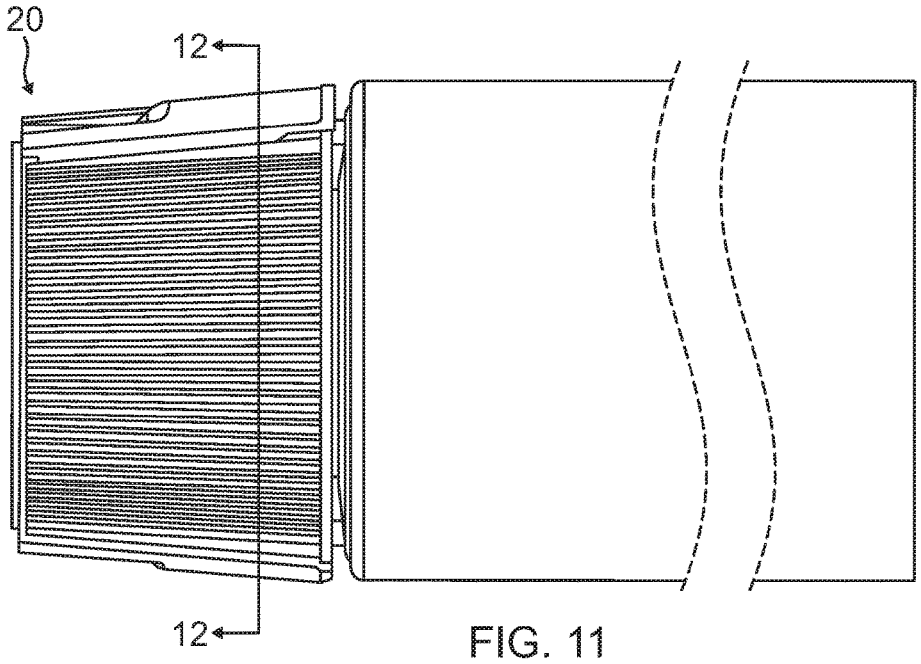
FIG. 11 is an exterior side view of the cap of the present invention.
Figure 12:
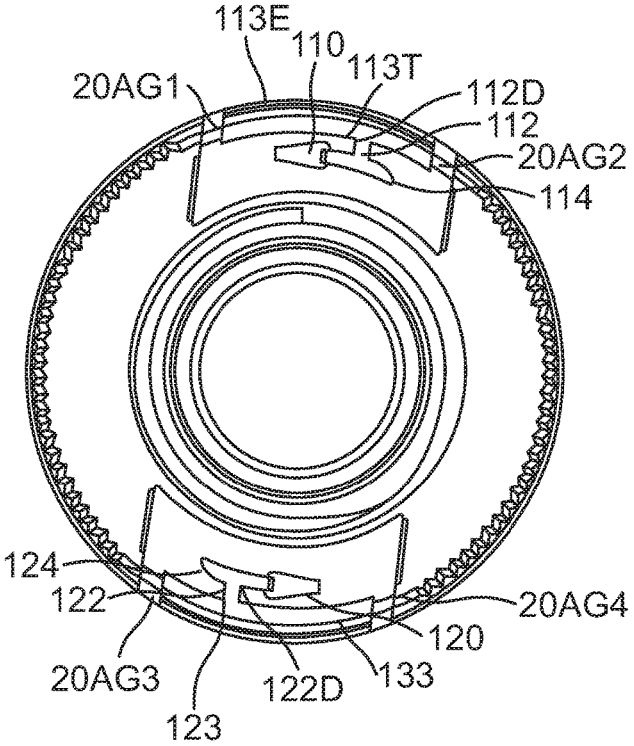
FIG. 12 is a cross-sectional view taken along line 12-12 of FIG. 11.
Figure 13:
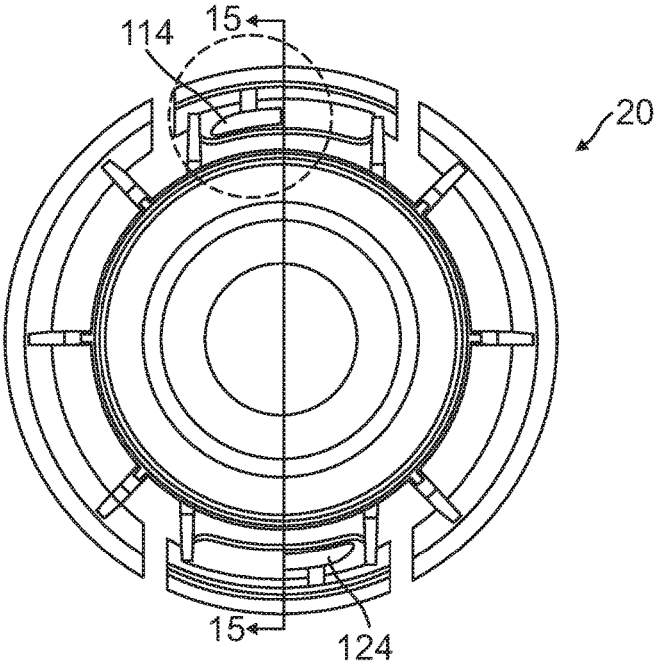
FIG. 13 is a cross-sectional of the cap illustrating a pair of oppositely disposed cap locking teeth.
Figure 14:
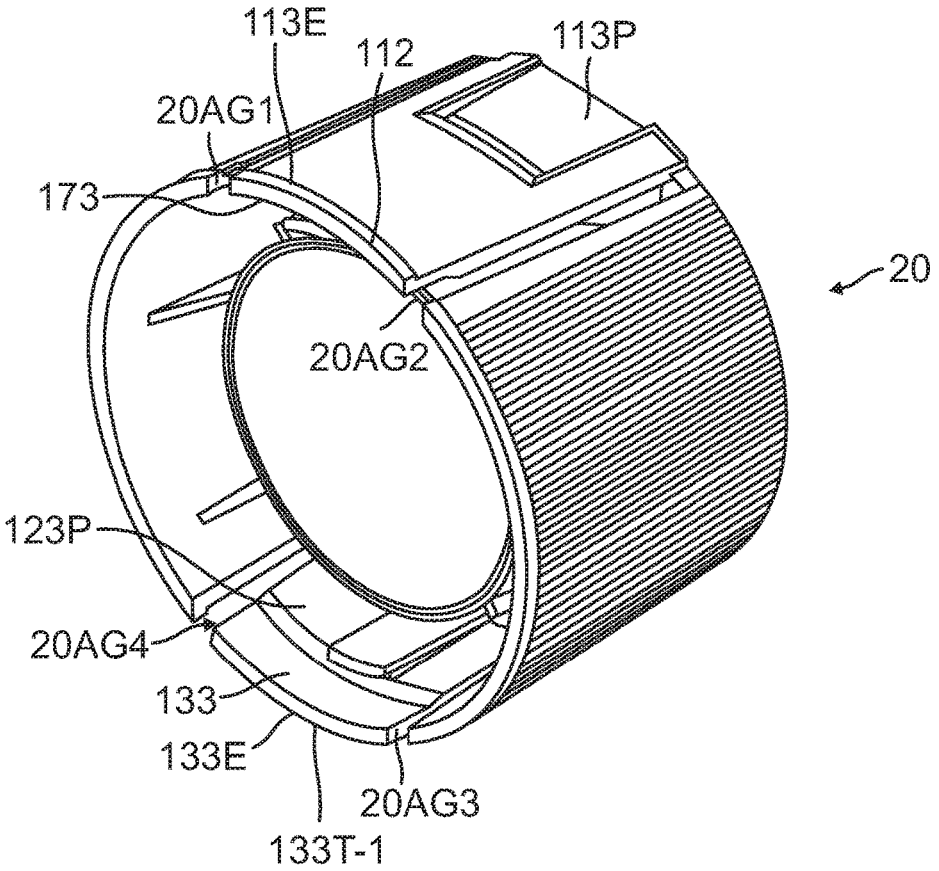
FIG. 14 is a bottom plan view of the locking assembly on the cap.
Figure 15:
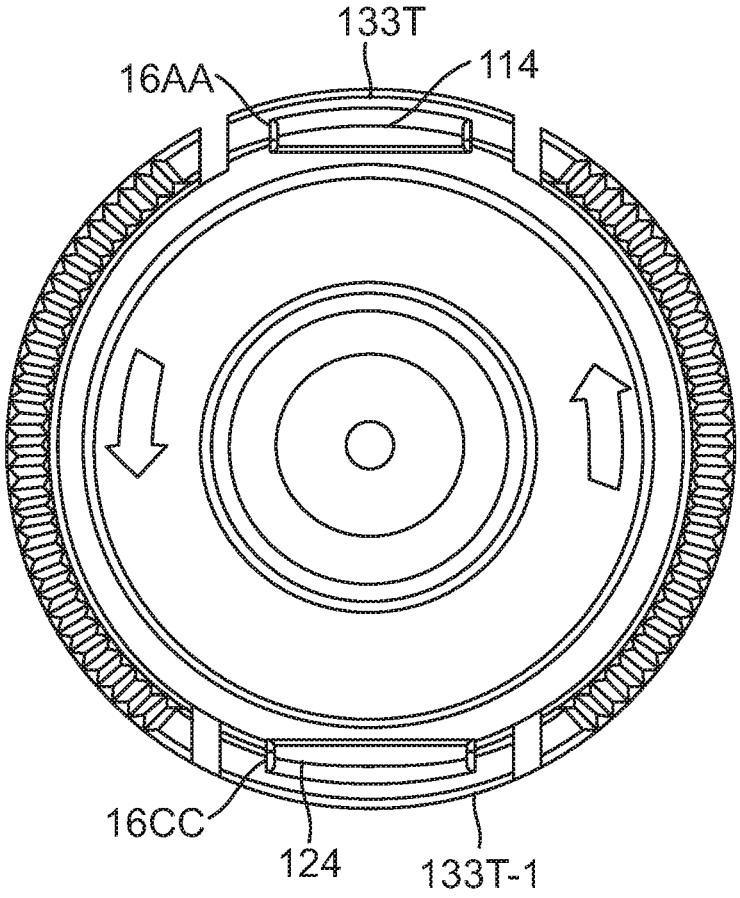
FIG. 15 is a bottom cross-sectional view of the cap in the locked position.

FIG. 11 is an exterior side view of the cap of the present invention. FIG. 12 is a cross-sectional view taken along line 12-12 of FIG. 11. FIG. 13 is a cross-sectional view of the cap illustrating a pair of oppositely disposed cap locking teeth. FIG. 14 is a bottom plan view of the locking assembly on the cap. FIG. 15 is a bottom cross-sectional view of the cap in the locked position.

FIG. 5 is a side elevational view of the container 10 with the cap removed and illustrating a pair of oppositely disposed tube standoffs 10AA and 20AA. FIG. 8 is a front view taken from lines 8-8 of FIG. 5, illustrating tube standoff 10AA having a body 14AA and a cavity 16AA. Similarly, oppositely disposed tube standoff 20AA has a body 24AA with a cavity 26AA.

FIG. 10 is a side view of the cap 20 illustrated in partial cross-section to illustrate a portion of the locking assembly 100 which is a stand-off 10AA with a body 14AA and cavity 16AA within the cap 20. FIG. 11 is an exterior side view of the cap 20 of the present invention. FIG. 12 is a cross-sectional view taken along line 12-12 of FIG. 11. The cap 20 has a first locking member 110 having a transverse bar 112 extending from an interior wall section 113T toward the interior of the cap 20 and locking tooth 114 at the distal end 112D. A pair of gaps 20AG1 and 20AG2 are on either end of interior wall section 113T. Similarly, cap 20 has a second locking member 120 having a transverse bar 122 extending from an interior wall section 123 extending toward the interior of cap 20 and a locking tooth 124 at the distal end 122D. The pair of gaps 20AG3 and 20AG4 are on either end of interior wall section 123. Gaps 20AG1 and 20AG2 enable the cap 20 to be rotated. Similarly, gaps 20AG3 and 20AG4 enable the cap 20 to be rotated.

FIG. 13 is a cross-sectional view illustrating a pair of oppositely disposed cap locking teeth 114 and 124. FIG. 14 is a bottom plan view of the locking assembly on the cap.

In order to lock the cap 20, the cap 20 is pressed inwardly at the location 133E of interior wall 113 where locking tooth 114 is located just in front of the cavity 16A of tube standoff 10AA and is concurrently pressed inwardly at the exterior wall location 133E corresponding to the location 133T of interior wall 133 where locking tooth 124 is located just in front of cavity 16CC of tube standoff 10CC. Therefore, the tooth 114 is aligned with cavity 16AA of tube standoff 10AA and the tooth 124 is aligned with cavity 16CC of tube standoff 20AA. By rotating the cap 20A in one direction such as counter-clockwise, the respective teeth 114 and 124 engage a respective cavity 16AA and 26CC to lock the cap 20 onto the cylinder 10.

To unlock, the cap 20 must be pressed inwardly at the exterior wall location 113 corresponding to the location of interior wall 113T where locking tooth 114 is located inside of the cavity 16AA of the tube standoff 10AA and is concurrently pressed inwardly at the exterior wall location 133 corresponding to the location of interior wall 113E where locking tooth 124 is inside of the cavity 16CC of tube standoff 20AA and the cap 20 is rotated in an opposite direction to disengage tooth 114 from cavity 16AA and disengage tooth 124 from cavity 26CC and then cap 20 off of cylinder 10.

The present invention cap is used with all variations of sidewalls including oval, elliptical and cylindrical.

The cap 20 has an extra indentation member 113P and an oppositely disposed indentation member 123P. The indentation markers 113P and 123P serve as a guide as to where to inwardly press the cap 20 and rotate the cap into the locked or unlocked position.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus comprising:

a. a container having a closed rear end, a flexible sidewall, a front wall with an opening to receive a rollerball applicator, said closed rear wall, flexible sidewall, front wall and rollerball applicator surrounding an interior chamber, said rollerball applicator partially extending into the chamber and partially extending away from said front wall;

b. said flexible sidewall made of material selected from the group consisting of rolled laminated plastic having from one (1) to eight (8) layers of rolled laminated plastic and rolled laminated aluminum having from one (1) to eight (8) layers of rolled laminated aluminum; and c. said cap removably affixed to said container, said cap and container also including a locking member having:

(i) a first standoff affixed to the front wall of said container between said rollerball applicator and a circumferential exterior of the front wall, and an oppositely disposed second standoff affixed to the front wall of said container between said rollerball applicator and a circumferential exterior of the front wall, (ii) the first standoff having a first body with a first cavity extending from a surface of the first body into the first body, (iii) the second standoff having a second body with a second cavity extending from a surface of the second body into the second body, (iv) said cap having a first locking member including a first transverse bar extending from a first interior wall section toward an interior of said cap and a first locking tooth at a distal end of the first transverse bar, first interior wall spacer cavities at both a first end and a second end of the first interior wall, the first locking tooth adapted to align with said first cavity, (v) said cap having a second locking member including a second transverse bar extending from a second interior wall section toward an interior of said cap and a second locking tooth at a distal end of the second transverse bar, second interior wall spacer cavities at both a first end and a second end of the second interior wall, the second locking tooth adapted to align with said second cavity, (v) said cap having an exterior wall including a first marker aligned with said first interior wall section and a second marker aligned with said second interior wall section;

d. whereby, a simultaneous inward pressure on said cap at the locations of said first and second marker and said first interior wall and said second interior wall section and rotation of said cap enables said first tooth to engage said first cavity and said second tooth to engage said second cavity to lock said cap onto a front of said container, and removing said cap from said container requires finding the locations of said first marker and said second marker to cause a simultaneous inward force on said first marker and said first interior wall section and on said second marker and said second interior wall section and anti-rotation of said cap to disengage said first tooth from said first cavity and said second tooth from said second cavity.

2. The apparatus in accordance with claim 1, further comprising: said sidewall is formed in a shape selected from the group consisting of oval-shaped, elliptical-shaped and cylindrical-shaped.

3. The apparatus in accordance with claim 1, further comprising: said rolled laminated plastic is selected from the group consisting of polypropylene, polyethylene, polyvinyl, and combinations including one or more of said polypropylene, polyethylene, polyvinyl.

4. An apparatus comprising:

a. a container having a closed rear end, a flexible sidewall, a front wall with an opening to receive an applicator, said closed rear wall, flexible sidewall front wall and applicator surrounding an interior chamber;

b. said flexible sidewall made of material selected from the group consisting of rolled laminated plastic having a multiplicity of layers of rolled laminated plastic and of rolled laminated metal having a multiplicity of rolled laminated metal; and c. said cap removably affixed to said container, said cap and container also including a locking member having:

(i) a first standoff affixed to the front wall of said container between said applicator and a circumferential exterior of the front wall, and an oppositely disposed second standoff affixed to the front wall of said container between said rollerball applicator and a circumferential exterior of the front wall, (ii) the first standoff having a first body with a first cavity extending from a surface of the first body into the first body, (iii) the second standoff having a second body with a second cavity extending from a surface of the second body into the second body, (iv) said cap having a first locking member including a first transverse bar extending from a first interior wall section toward an interior of said cap and a first locking tooth at a distal end of the first transverse bar, first interior wall spacer cavities at both a first end and a second end of the first interior wall, the first locking tooth adapted to align with said first cavity, (v) said cap having a second locking member including a second transverse bar extending from a second interior wall section toward an interior of said cap and a second locking tooth at a distal end of the second transverse bar, second interior wall spacer cavities at both a first end and a second end of the second interior wall, the second locking tooth adapted to align with said second cavity;

d. whereby, a simultaneous inward pressure on said cap at the locations of said first interior wall section and said second interior wall section and rotation of said cap enable said first tooth to engage said first cavity and said second tooth to engage said second cavity to lock said cap onto a front of said container, and removing said cap from said container requires finding the locations of said first interior wall section and said second interior wall section to cause a simultaneous inward force on said cap and anti-rotation of said cap to disengage said first tooth from said first cavity and said second tooth from said second cavity.

5. The apparatus in accordance with claim 4, further comprising: said applicator is a rollerball.

6. The apparatus in accordance with claim 4, further comprising: said sidewall is in a shape selected from the group consisting of oval-shaped, elliptical-shaped and cylindrical-shaped.

7. The apparatus in accordance with claim 4, further comprising: said rolled laminated plastic is selected from the group consisting of polypropylene, polyethylene, polyvinyl, and combinations including one or more of said polypropylene, polyethylene, polyvinyl.

8. The apparatus in accordance with claim 4, further comprising: said rolled laminated metal is aluminum.

9. The apparatus in accordance with claim 4, further comprising: said rolled laminated plastic having from two (2) to eight (8) layers of rolled laminated plastic and said rolled laminated metal having from two (2) to eight (8) layers of rolled laminated metal.

10. An apparatus comprising:

a. a container having a closed rear end, a flexible sidewall, a front wall with an opening to receive an applicator, said closed rear wall, flexible sidewall, front wall and applicator surrounding an interior chamber, b. said flexible sidewall made of material selected from the group consisting of rolled laminated plastic having a multiplicity of layers of rolled laminated plastic and of rolled laminated metal having a multiplicity of rolled laminated metal; and c. a cap removably affixed to said container with a child-resistant locking assembly;

d. a first standoff affixed to the front wall of said container between said applicator and a circumferential exterior of the front wall, and an oppositely disposed second standoff affixed to the front wall of said container between said applicator and a circumferential exterior of the front wall;

e. the first standoff having a first body with a first cavity extending from a surface of the first body into the first body;

f. the second standoff having a second body with a second cavity extending from a surface of the second body into the second body;

g. said cap having a first locking member including a first transverse bar extending from a first interior wall and a first locking tooth attached to the first transverse bar, first interior wall spacer cavities at both a first end and a second end of the first interior wall, the first locking tooth adapted to align with said first cavity; and h. said cap having a second locking member including a second transverse bar extending from a second interior wall and a second locking tooth affixed to the second transverse bar, second interior wall spacer cavities at both a first end and a second end of the second interior wall, the second locking tooth adapted to align with said second cavity;

i. whereby, a simultaneous inward pressure on said cap at the locations of said first interior wall and said second interior wall section and rotation of said cap enables said first tooth to engage said first cavity and said second tooth to engage said second cavity to lock said cap onto a front of said container, and removing said cap from said container requires finding the locations of said first interior wall and said second interior wall to cause a simultaneous inward force on said cap and anti-rotation of said cap to disengage said first tooth from said first cavity and said second tooth from said second cavity.

11. The apparatus in accordance with claim 10, further comprising: said applicator is a rollerball.

12. The apparatus in accordance with claim 10 further comprising: said sidewall is in a shape selected from the group consisting of oval-shaped, elliptical-shaped and cylindrical-shaped.

13. The apparatus in accordance with claim 10, further comprising: said rolled laminated plastic is selected from the group consisting of polypropylene, polyethylene, polyvinyl, and combinations including one or more of said polypropylene, polyethylene, polyvinyl.

14. The apparatus in accordance with claim 10, further comprising: said rolled laminated metal is aluminum.

15. The apparatus in accordance with claim 10, further comprising: said rolled laminated plastic having from two (2) to eight (8) layers of rolled laminated plastic and said rolled laminated metal having from two (2) to eight (8) layers of rolled laminated metal.

* * * * *